US008967496B1

(12) United States Patent
Blake

(10) Patent No.: US 8,967,496 B1
(45) Date of Patent: Mar. 3, 2015

(54) HYDRA-PNEUMATIC SYSTEM PUMP

(76) Inventor: William Sydney Blake, Linwood, NJ (US)

( * ) Notice: Subject to any disclaimer, the term of this patent is extended or adjusted under 35 U.S.C. 154(b) by 0 days.

(21) Appl. No.: 12/660,035

(22) Filed: Feb. 19, 2010

(51) Int. Cl.
*B05B 7/14* (2006.01)

(52) U.S. Cl.
USPC ..... 239/322; 239/318

(58) Field of Classification Search
USPC ..... 239/305, 310, 311, 337, 312; 222/321.6, 321.8, 321.9, 335
See application file for complete search history.

(56) References Cited

U.S. PATENT DOCUMENTS 3,788,521 A * 1/1974 Laauwe ..... 222/94
2007/0102542 A1* 5/2007 MacLean-Blevins ..... 239/318

* cited by examiner

*Primary Examiner* — Len Tran
*Assistant Examiner* — Viet Le
(74) *Attorney, Agent, or Firm* — Dennis H. Lambert

(57) ABSTRACT

An actuator and nozzle assembly for a dispensing device for dispensing product under pressure, wherein a product chamber is supported within an outer container and a source of pressurized air pressurizes the product to dispense it through the nozzle. A stem valve normally biased to closed position is opened by an actuator reciprocal on a coupling member that attaches the actuator to the outer container. A first valve controls flow of pressurized air to the nozzle, and a second valve controls flow of product to the nozzle. In a first position of the actuator flow of air to the nozzle is enabled and in a second position flow of product is also enabled. Release of the actuator first interrupts flow of product then interrupts flow of pressurized air.

17 Claims, 10 Drawing Sheets

HYDRA-PNEUMATIC SYSTEM PUMP

BACKGROUND OF THE INVENTION

1. Field of the Invention

The present invention relates to dispensers, and more specifically to duration spray dispensers that do not rely upon propellant gases that are harmful to the environment.

2. Background Art

Both propellant driven and mechanically operated aerosol dispensers are and have been in use for many years and are still popular due to their convenience. However, propellant driven dispensers that rely upon chemical propellants are being scrutinized more closely and restrictions imposed upon them due to the adverse impact of these propellants upon the environment, as well as the hazards of handling them and the related insurance issues.

Mechanically operated spray dispensers lack the convenience of propellant driven dispensers, but they are bulky and require a large amount of material and parts to produce. Moreover, energy costs keep rising, resulting in increased costs to mold and manufacture them. Further, persons suffering from arthritis or other infirmities find it difficult to use mechanically operated dispensers due to the multiple steps required in their operation. In some cases, the number of parts required in the construction of these devices makes them too costly for consumers. On the other hand, manufacturers of lower cost propellant-driven products, including bag-in-a-can and pressure driven piston devices, are reluctant in general to change from the propellant-driven aerosol systems. A new consideration is not favorable.

Systems other than propellant driven types use other alternatives for dispensing product. For example, some devices employ means with storage chambers, requiring the transfer of product within a two stage loading process, wherein a metered amount of product must be obtained from a storage chamber as the first stage and then transferred into a second stage power chamber before it can be dispensed from the second stage over a given duration. Other systems require venting, exposing the product to atmosphere during extensive periods between usage by the consumer. This can affect the efficacy of product and cause potential clogging and possible contamination as well. There is still a need to isolate the product from air or propellants within the container. The mechanically operated non-propellant systems are more appealing in lots of ways in that the environment is protected from harmful propellants and the process is less vulnerable to liabilities and constraints presently imposed on delivery systems using chemical propellants. The present invention offers an alternative that still provides equivalent results in delivering products such as food without preservatives, room fresheners, hairsprays, furniture polishes, personal care and pharmaceutical products without the problems that chemical propellants and venting pose.

The following patents exhibit some of the pitfalls of prior art devices.

| | | |
|---|---|---|
| U.S. Pat. No. 3,022,923 | Hoffman Jr. | Utilizes a gaseous propellant driven piston cup to expel product through a valve means. |
| U.S. Pat. No. 3,319,420 | Mercer | A pressure vessel with intervening bladder of a non-permeable material which houses and isolates oil or oil base products from the surrounding compressed gas. |
| U.S. Pat. No. 3,494,513 | Bauer | Utilizes a cascading ductile metal bladder expulsion tank, folded in accordion fashion |
| U.S. Pat. No. 3,788,521 | Laauwe | An aerosol system with a rigid vessel and an inner flexible container similar to a bag-on-valve. |

-continued

| | | |
|---|---|---|
| U.S. Pat. No. 3,790,034 | Horvath | Rechargeable cam operated sprayer device. |
| U.S. Pat. No. 4,057,176 | Horvath | A vertical finger pump that utilizes air assist on each reciprocal actuation of the actuator. |
| U.S. Pat. No. 4,067,499 | Cohen | Uses a collapsible bellows or piston in a bore of a product vessel as a non-venting system. |
| U.S. Pat. No. 4,249,676 | Beery | A vertical actuated Pump with an Air Vent Check valve that prevents outward flow of liquid through the air intake passage. |
| U.S. Pat. No. 6,708,853 B2 | B1ake | Uses storage chamber and venting that exposes product. |
| WO 95/01300 | Abplanalp | Uses an Air charge upon Vessel of product. |

The systems disclosed in the prior art cited above are generally too expensive for commercial acceptance and feasibility in some market applications for mass production at high levels.

Despite the efforts of such devices as shown in the forgoing patents, there remains a need for a more convenient, compact, portable, self-charged duration spray device that can perform in most environments, is operated in a way that is comparable to the devices that consumers are accustomed to, is easy to use and environmentally friendly, and does not contaminate the product or require venting. Applicant is not aware of any currently available system that could be considered "GREEN" and user friendly as well.

SUMMARY OF THE INVENTION

It is an object of the present invention to provide a system that is simple and economical in construction and operation.

It is another object of the present invention to provide a product dispenser that does not rely upon harmful propellants that contaminate the atmosphere as well as some products to be dispensed.

It is a further object of the present invention to provide the means to select a variety of product holding chambers utilizing piston driven or collapsible pouches and bags.

Yet another object of the present invention is to employ an air pressurized breakup feature supplied from the initial supply chamber via a valve controlled release means that isolates the air from the product until the product exits the dispensing nozzle.

An even another object of the present invention is to provide a refillable option to the system.

A further object of the invention is to provide a dispenser construction that enables a number of feature enhancements to be made without requiring a major reconstruction of the basic system.

Yet another further object of the present invention is to provide the option in the basic system of using air assist or not using air assist in the nozzle means, depending upon the product to be dispensed.

These and other options and advantages presented by the present invention comprise distinctive features that enhance the system with the options as part of the unique compressed gas pump mechanism, allowing the device to be trigger operated or plunger operated in either a vertical or a horizontal orientation. The system comprises a product chamber and a pressure chamber with a charging pump means to pressurize the pressure chamber and the product chamber. Pressurized product is discharged from the product chamber via a dual sequential release valve mechanism. The invention provides a controlled dispensing cycle and aerosolized system, if selected, that constantly keeps the pressure source isolated from the product to be dispensed. With appropriate substitution of available features, the system may be used to dispense a variety of products, including, but not limited to, toothpaste, soap, shampoo, or a contoured ribbon of product. The system can dispense product as a spray through a mechanical breakup unit (MBU), or as a foam. The invention can also provide a spray-through cap and/or different shaped containers for a variety of product viscosity ranges. The actuator nozzle pocket can incorporate a non-clog insert as described in U.S. Pat. Nos. 6,609,666 and 6,543,703 as enhancement features in the present invention, especially with respect to the tangential slots producing a vortex in the air flowing through the nozzle.

The system could be adapted to a bag-on-valve arrangement or to a preloaded product chamber that has its own spring or preloaded charge and does not rely upon the pressurized air produced by the pump means or an external pressure source. The flexible spring fitments and/or product chamber could be made of metal or other suitable material. Added control is available by the selection of nozzles and the need of how products feed with optimum results through them. The discharge of product is sequentially obtained. In brief, the actuator is depressed and when it reaches a first Intermediate position air starts to flow. Continued depression of the actuator causes product to flow and mix with air dependent upon a preset and or prescribed selected adjustment of the nozzle if a mix is desired. By releasing the actuator, the sequence is reversed and the air discharge is the last to exit the actuator, resulting in a self-purging system. To eliminate the air mix and obtain product only, the adjustable actuator can be set accordingly. The adjustable actuator can be manufactured so that the consumer is able to select settings for optimum results. Alternatively, the manufacturer can produce the system with fixed settings for optimum results.

In general, the invention comprises an actuator and nozzle assembly for a dispensing device for dispensing a product under pressure, wherein a product chamber is supported within an outer container and a lower air chamber is defined between said product chamber and said outer container. Pressurizing means is associated with the outer container for pressurizing air in said lower air chamber and pressurizing product in said product chamber. An actuator is mounted to said outer container, and nozzle means is in said actuator. First flow passage means extend from said lower air chamber to said nozzle means, and second flow passage means extend from said product chamber to said nozzle means for conveying product from the product chamber and through said nozzle means. First valve means is in said first flow passage means for controlling flow of pressurized air from said lower air chamber to and through said nozzle means, and second valve means is in said second flow passage means for controlling flow of product from said product chamber to and through said nozzle means. Said first and second valve means are operated by said actuator so that in a first position of said actuator flow of pressurized air is enabled from said lower air chamber to and through said nozzle means and in a second position flow of product is enabled from said product chamber to and through said nozzle means. Release of said actuator first interrupts flow of product then interrupts flow of pressurized air.

More specifically, the invention comprises an actuator and nozzle assembly for a dispensing device for dispensing a product under pressure, comprising:

an outer container having a sidewall, an upper end, and a bottom end, said upper end having at least one flow port therethrough and a central opening;

attaching means on said upper end for attaching a product chamber to said upper end so that said product chamber is supported in said outer container in communication with said central opening;

a valve seal pocket formed in said central opening, said valve seal pocket having a valve seat therein;

a coupling member attached to said container upper end on a side thereof opposite said attaching means, said coupling member having an upstanding side wall and a yieldable spring-like upper end wall with a downwardly projecting center portion having a center opening therethrough;

a combined valving and spring member secured between said container upper end and said coupling member so that it is disposed around said central opening in said container upper end, at least one spring arm extending inwardly from said valving and spring member in overlying spaced relation to said container upper end, and a valve flap on said valving and spring member normally disposed in closed relationship over said at least one flow port through said container upper end;

an actuator reciprocable on said coupling member, said actuator having a top wall, an outer side wall depending from said top wall and telescopically engaged on said coupling member side wall, said outer side wall having an opening through one side thereof adjacent said top wall, a first inner wall depending from said top wall in inwardly spaced concentric relation to said outer side wall, said first inner wall being engaged against said coupling member flexible upper end wall, and a center hub supported in inwardly spaced concentric relationship with said first inner wall, said hub having an upper end and a lower end and a bore extending through the lower end thereof, a side opening extending through one side of the hub adjacent said upper end thereof and communicating with an upper end of said bore, said side opening in said hub being in alignment with said opening through one side of the actuator outer side wall, and a bottom end seal on the bottom end of said hub, said bottom end seal normally seated against the coupling member upper end wall and closing the center opening therethrough;

a stem valve having an upper end and a lower end and having a hollow interior extending through said upper end from adjacent but spaced from said lower end, said upper end extending through the center opening in said spring-like upper end wall of said coupling member and being slidably sealed in the bore in said hub, the lower end of said stem valve extending into said valve seal pocket and having a sliding seal member thereon slidably sealed in said valve seal pocket and a valve member on said lower end for cooperation with the valve seat in the valve seal pocket, and at least one opening through a side of said stem valve between said sliding seal member and said valve member establishing fluid communication between said product chamber and said hollow interior when said valve member is unseated, said at least one spring arm engaged against a midportion of said stem valve to urge it into closed position, and said midportion defining an abutment against which the downwardly projecting center portion of said spring-like upper end wall of said coupling member abuts when said actuator is depressed;

said container and said product chamber defining a space between them forming a first portion of a lower air chamber, said upper end of said container and said coupling member forming a second portion of a lower air chamber, and said actuator and said flexible upper end wall of said coupling member forming an upper air chamber separated and sealed from said lower air chamber by seating of the bottom end seal on said hub against the coupling member upper end wall and closing the center opening therethrough;

pressure means for pressurizing said first portion of said lower air chamber and applying pressure to product in said product chamber, said valve flap being opened upon pressurization of said first portion of said lower air chamber to establish communication between said first and second portions of said lower air chamber and thus pressurize said second portion;

a nozzle secured in said opening through said opening in one side of said outer side wall of said actuator; and a tube extending from said opening in the side of said hub to said nozzle; wherein depression of said actuator to a first position moves said first inner wall against said flexible upper wall of said coupling member to flex said upper wall downwardly to unseat the bottom end seal on said hub from said center opening and admit pressurized air from said lower air chamber to said upper air chamber and through said nozzle, and continued depression of said actuator to a second position further moves said flexible upper end wall to abut said stem valve midportion and move said stem valve to unseat said valve member from the valve seat in the valve seal pocket and permit pressurized product to flow up through the hollow stem valve and through the tube to be dispensed through the nozzle, and wherein release of said actuator first enables said at least one spring arm to move said stem valve to a closed position to stop flow of product through the stem valve and nozzle while continuing to permit flow of pressurized air through the nozzle, and the flexible upper end wall of said coupling member then moves into closed relationship against said bottom end seal to close off flow of pressurized air.

BRIEF DESCRIPTION OF THE DRAWINGS

The accompanying drawings, which are incorporated in and form a part of the specification, illustrate some preferred embodiments of the present invention, and together with the detailed description, will serve to explain the principles of the present invention.

DETAILED DESCRIPTION OF THE PREFERRED EMBODIMENTS

Figure 1:
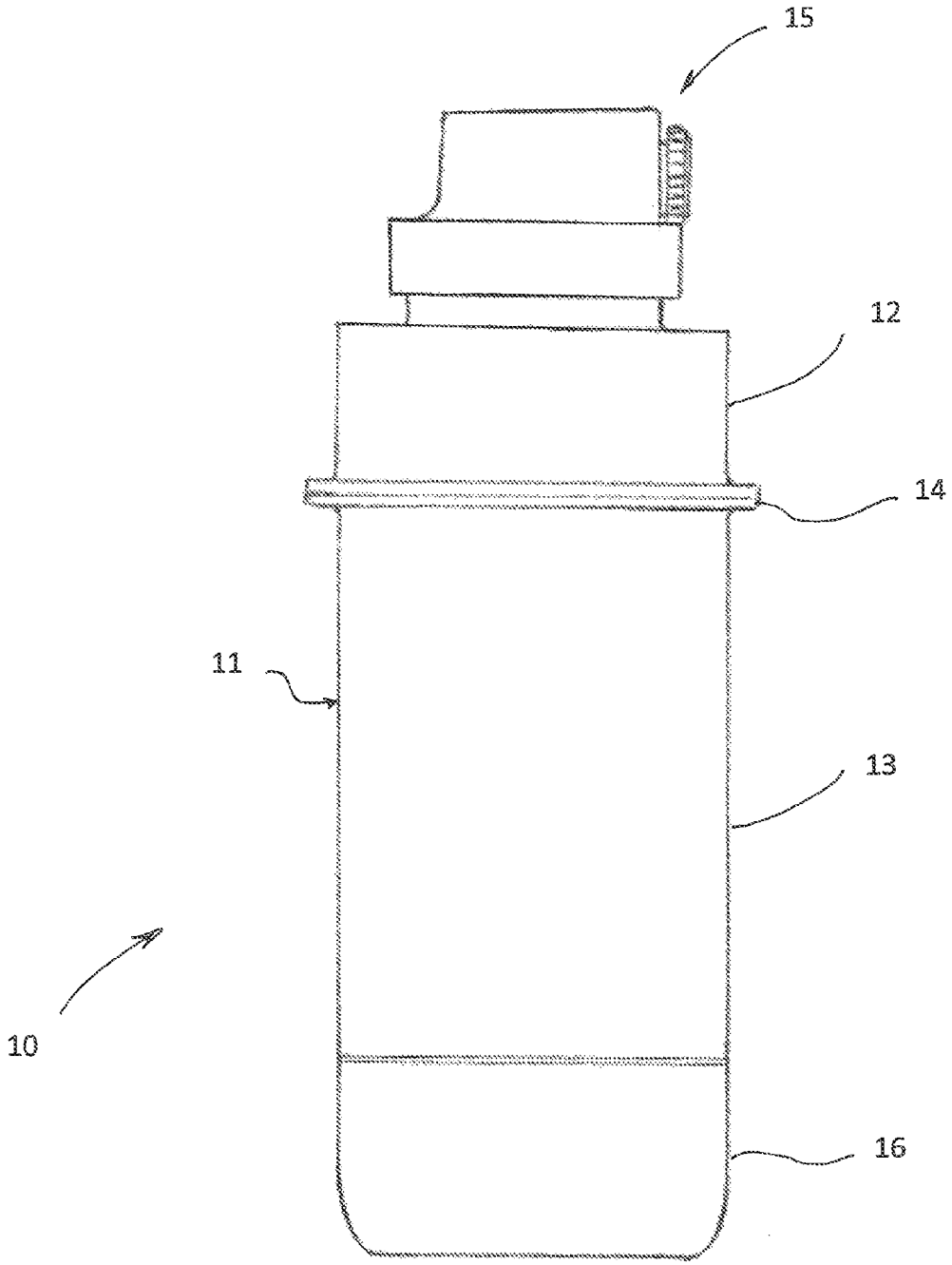
FIG. 1 is a side view in elevation of a preferred embodiment of the invention, showing the mechanism assembly on a container, with the over cap omitted.

Referring more specifically to the drawings, a first form of dispenser according to the invention is indicated generally at 10 in FIG. 1 and comprises an outer container housing 11 having an upper housing portion 12 joined to a lower housing portion 13 at a juncture 14 that may be sonic welded, glued, solvent welded, threaded or otherwise suitably fastened. An actuator and nozzle assembly 15 is mounted to the upper housing portion, and in the example shown, a manually operated pump 16 such as that shown in FIGS. 11 and 12, for example, is assembled to the bottom of the lower housing portion.

Figure 2:
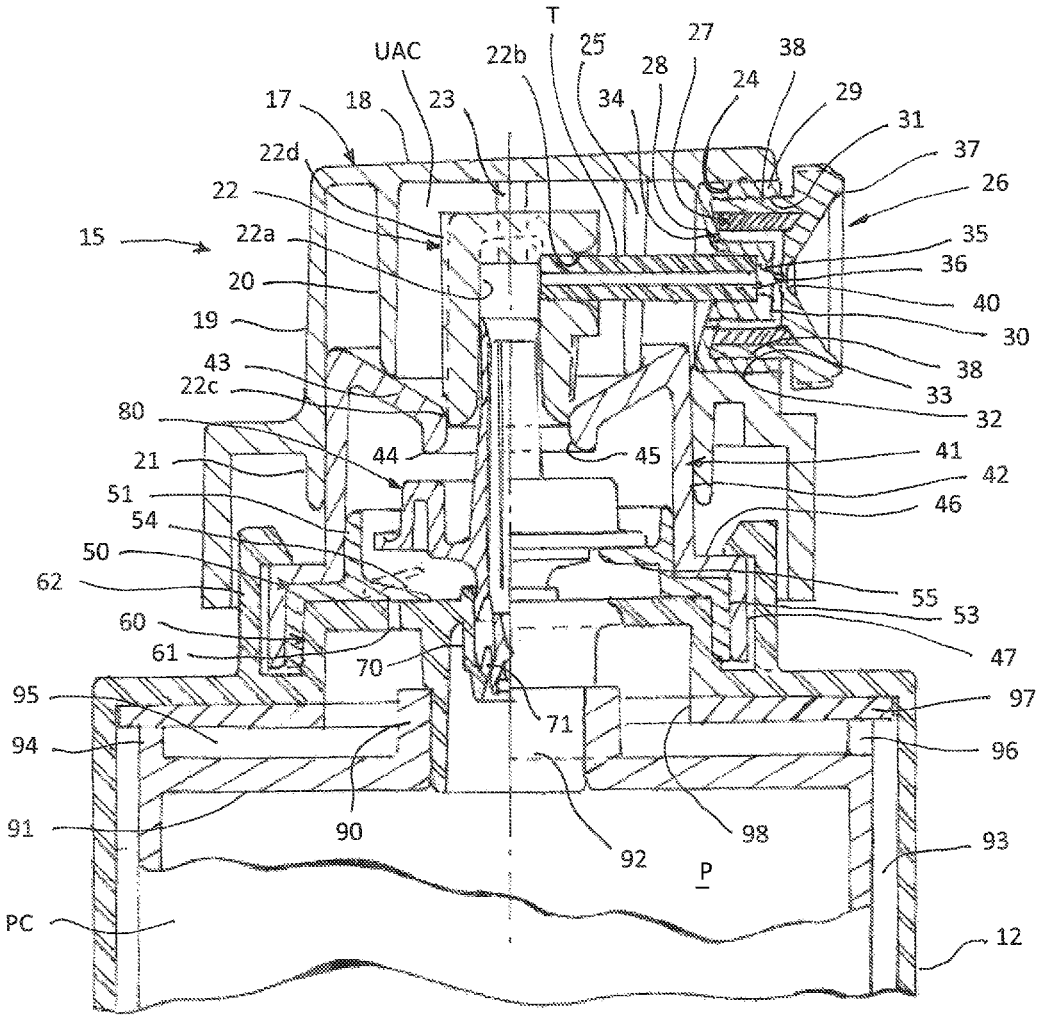
FIG. 2 is an enlarged, fragmentary, longitudinal partial cross-sectional view of the preferred embodiment of an air assist mechanism assembly utilizing a conditional mix or blend of air and product and using a MBU as shown and described in U.S. Pat. No. 6,609,666, for example, wherein the assembly is shown in an initial at-rest position.
Figure 2A:
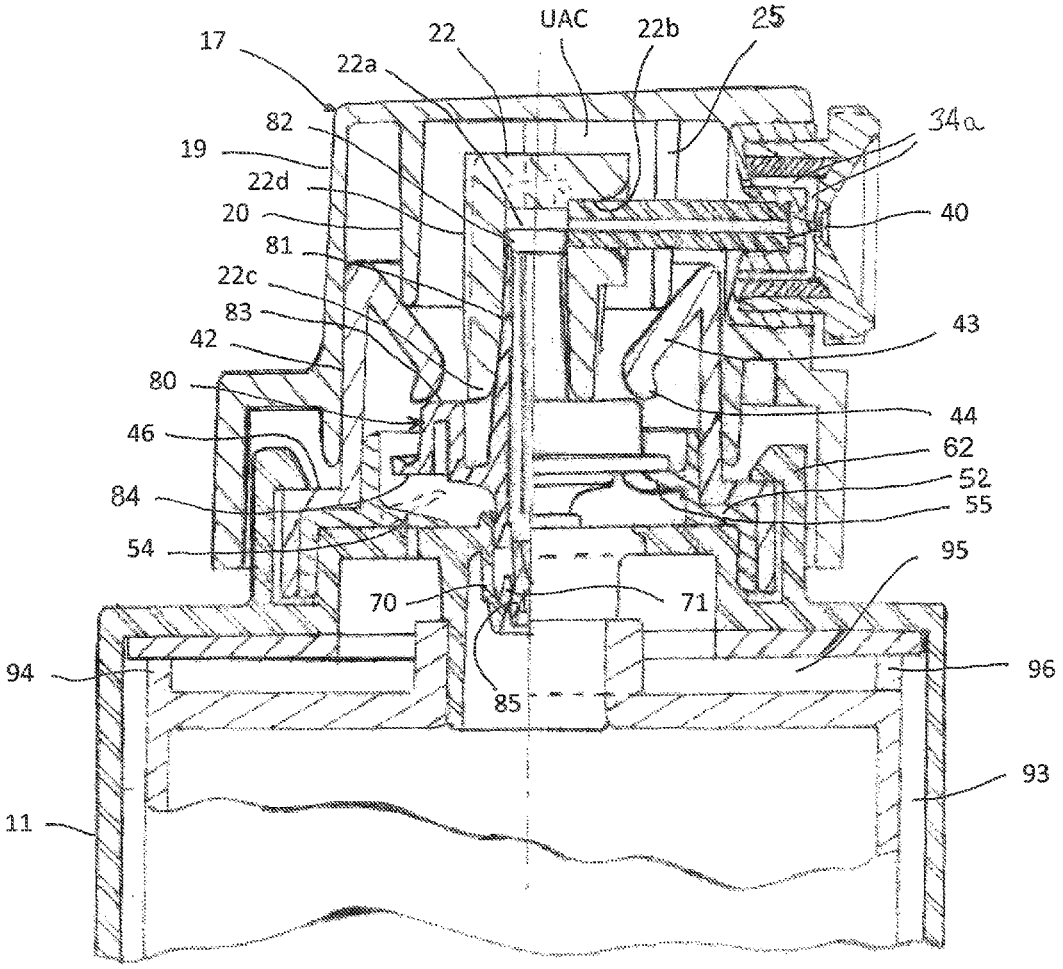
FIG. 2*a* is an enlarged, fragmentary, longitudinal partial cross-sectional view of the air assist means in FIG. 2, shown in an intermediate position of the two stage dispensing sequence for controlling an amount of air to be blended with the product at the nozzle outlet.
Figure 2B:
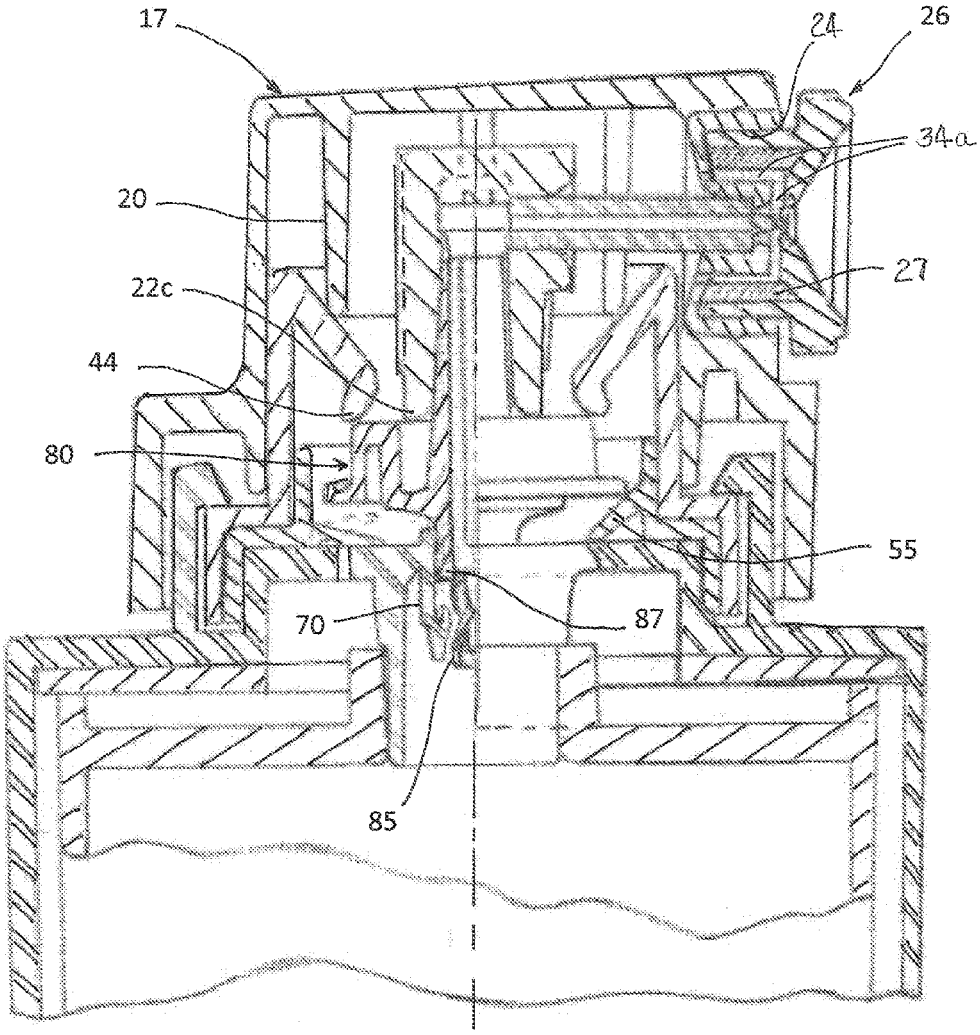
FIG. 2*b* is an enlarged, fragmentary, longitudinal partial cross-sectional view of the device of FIG. 2, showing a final sequence position wherein the previously separated air and fluid product are combined as they are emitted from the MBU nozzle.
Figure 3A:
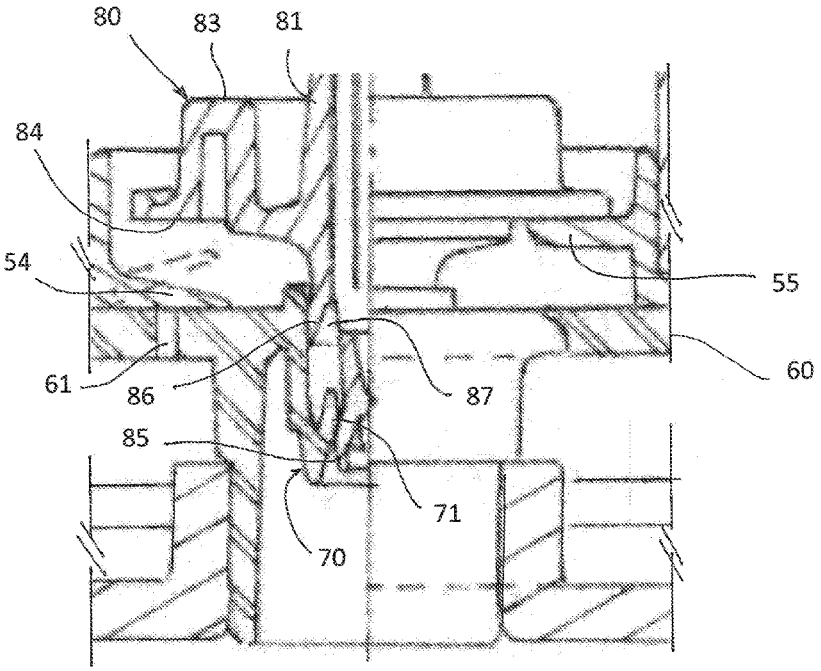
FIG. 3*a* is a greatly enlarged fragmentary view of the lower end of the stem valve and the associated seal pocket, shown prior to depression of the stem valve.
Figure 3B:
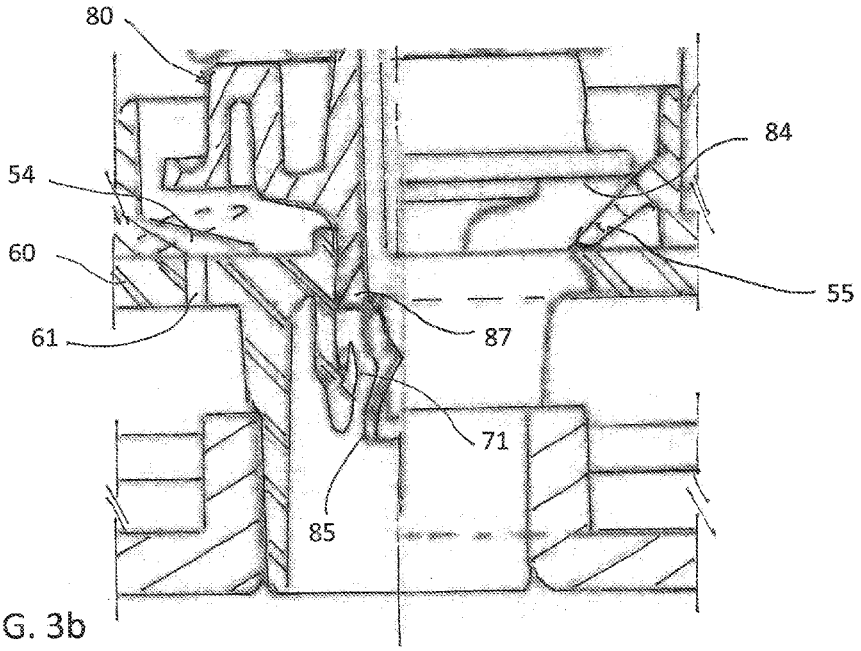
FIG. 3*b* is a greatly enlarged fragmentary view of the lower end of the stem valve and the associated seal pocket, shown after depression of the stem valve.

The structure and operation of the actuator and nozzle assembly 15 and its attachment to the upper housing portion 12 are best understood with reference to FIGS. 2, 2*a* and 2*b*. The actuator comprises a generally inverted cup-shaped actuator 17 having a closed top wall 18 and a cylindrical outer side wall 19 depending from its outer periphery, with a first inner cylindrical wall 20 depending from the top wall and a relatively short second inner cylindrical wall 21 spaced below and radially between the first inner wall 20 and the outer side wall 19. A center hub 22 with a hollow bore 22*a* extending most of its length and opening through the bottom end is integrally formed with the actuator and is supported below the top wall 18 in radially inwardly spaced concentric relationship with the first inner wall 20 by a pair of opposed ribs 23 (only one of which is shown) extending radially between the hub and the wall 20. A side opening 22*b* extends through one side of the hub 22 at the upper end of bore 22*a*, and a bottom end seal 22*c* is on the bottom end of the hub. One or more longitudinal ribs 22*d* extend up the outer surface of the hub from a point spaced slightly above the bottom end seal 22*c*.

An opening 24 is formed through the wall 19 of the actuator 17 near the top wall in substantial alignment with the side opening 22*b* in the hub, and a slot 25 is formed in the first inner wall 20 in radial alignment with and between the openings 22*b* and 24.

A nozzle assembly and mechanical breakup unit (MBU) 26 is mounted in opening 24 and comprises a threaded air feed adapter fitment 27 having an annular end wall 28 extending between an outer cylindrical wall 29 and a central socket 30. The wall 29 is internally threaded at 31 and retained in opening 24 by barbs 32 on the wall 29 engaged in recesses 33 in the opening 24. Openings 34 are formed through the end wall 28 immediately adjacent the socket 30, communicating with air vortex tangential slots 34*a* that lead to a series of annularly arranged opening 35 formed through the center of the closed end of the socket around a central conical nose or seal cone 36. An adjustable soft nozzle 37 has an externally threaded end 38 threaded into the outer wall 29 of the fitment 27, with an end wall having a central flexible pad and opening 40 for adjustment against the nose 36. A rigid sleeve 39 backs up and reinforces the threaded end 38. The soft nozzle provides a biased contact relationship with the nose 36 throughout the adjustment of nozzle 37. Many of these details are seen best in FIG. 7 wherein like parts are indicated by like reference numbers primed.

A tube T is fitted at one end in the opening 22*b* in the hub and at its other end in the socket 30 of the fitment 27 for conveying product from the bore 22*a* to the openings 35 in the end of the socket and thus through the opening 40 in the nozzle 37. The tube may be made with different internal diameters to alter the pressure supplied to the spray geometry mechanics within the adjustable nozzle.

Figure 5:
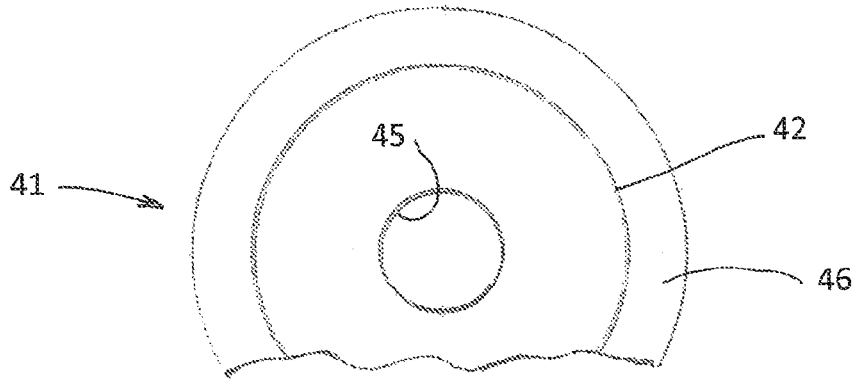
FIG. 5 is an end view of the coupling member shown in FIG. 4, with a portion broken away, taken in the direction of the arrow 5.
Figure 4:
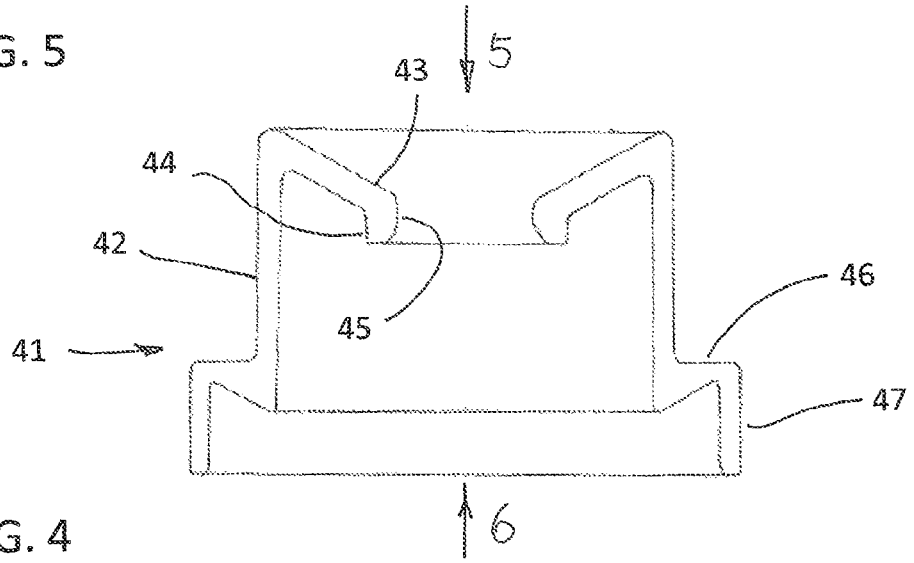
FIG. 4 is a longitudinal cross-sectional view of a coupling member as used in FIGS. 2, 2*a*, 2*b* and FIG. 3 and that assists in the two stage dispensing cycle.
Figure 6:
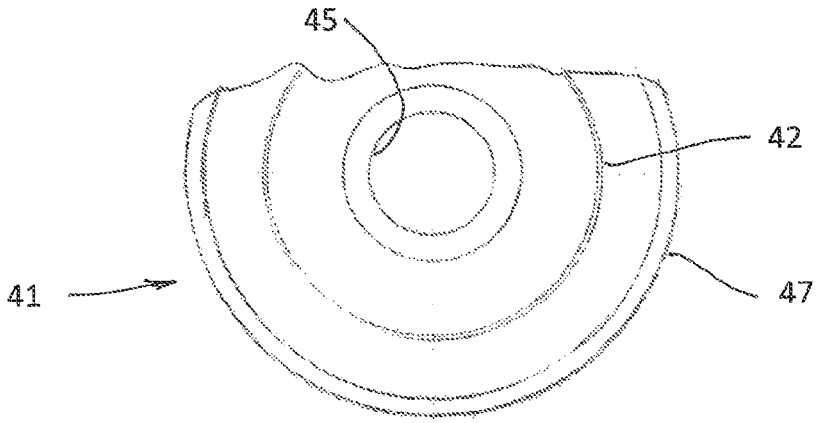
FIG. 6 is an end view of the coupling member shown in FIG. 4, with a portion broken away, taken in the direction of the arrow 6.

The actuator assembly 17 is mounted to an inverted generally cup-shaped coupling member 41, seen best in FIGS. 4-6, that comprises an upstanding cylindrical side wall 42 on which the actuator wall 19 is slidably received, an inverted frustoconically shaped flexible end wall 43 against which the bottom ends of the first inner wall 20 and the bottom end 22*c* of the hub 22 abut when the unit is in its at-rest position as shown in FIG. 2. The bottom end 44 of the frustoconically shaped wall has a central opening 45 therethrough, and the bottom end 22*c* of the hub seals in this opening when the assembly is in its at-rest position shown in FIG. 2. Upward flexing of the wall 43 is prevented by engagement with the first inner wall 20 and one or more longitudinally extending ribs 22*d* on the outside of the hub terminating at their bottom ends a short distance above the bottom end of the hub. A radially outwardly extending annular wall 46 on the bottom end of the wall 42 terminates at its lower end in a diametrically enlarged skirt 47 that is seated over an extended upper end 60 of the upper housing portion 12, as described more fully below.

A combined valving and spring member 50 is seated between the bottom end of the coupling member 41 and the extended upper end 60 of the housing 12. The valving and spring member has an upstanding cylindrical wall 51 with a radially extending annular wall 52 on its bottom end engaged between annular wall 46 of the coupling member and the housing extended upper end 60, and a depending skirt 53 engaged between skirt 47 of the coupling member and the annular upper outer surface of housing extended upper end 60. At least one flexible valve flap 54 is formed in the member 50 and is normally biased into closed relationship over an associated opening 61 formed through the end wall of housing extended upper end 60 of the housing 12. One or more flexible spring arms 55 extend radially inwardly from wall 51 for yieldably biasing a stem valve 80 upwardly as described hereinafter.

A plurality of upstanding flexible latches 62 project upwardly from the upper end of housing portion 12 in radially outwardly spaced relation to the extended upper end 60 and these latches are engaged over the outer edge of annular wall 46 of the coupling member 41 to hold the coupling member and combined valving and spring member 50 securely against the extended upper end 60 of the housing portion 12.

With reference to FIGS. 2, 2*a*, 2*b*, 3*a* and 3*b*, an elongate cylindrical seal pocket 70 with an upwardly extending and inwardly tapered valve seat 71 on its bottom end is formed in the center of the housing extended upper end 60 for cooperation with stem valve 80 as described hereinafter.

Stem valve 80 has an elongate, hollow, tapered tail piece 81 slidably received in the bore 22*a* of hub 22, with an outwardly flared seal 82 on the upper end of the tail piece effecting a sliding seal in the bore 22*a*. A diametrically enlarged midportion of the stem valve is shaped to provide an upwardly facing annular shoulder 83 and a downwardly facing annular flange 84. A lower end extending below the midportion has a bulbous annular product valve seal 85 on its bottom end and an outwardly flared annular sliding seal 86 between the midportion and the product valve seat 85. One or more openings 87 are formed through the side of the lower end just beneath the sliding seal 86.

A product chamber PC in the outer container housing 11 has a cylindrical extension 90 in the center of its upper wall 91 preferably releasably mounted on a nipple 92 projecting downwardly around the seal pocket 70 from the extended upper end 60 of the container housing upper portion 12. The diameter of the product chamber PC is slightly smaller than the diameter of the outer container housing 11, defining an annular space 93 between the side walls of the container housing 11 and the product chamber PC. A short upstanding annular wall 94 on the top end of the product chamber around its outer margin spaces the wall 91 a short distance from the end of the container housing, defining a space 95, and one or more openings 96 through the wall 94 establish communication for flow of air between the spaces 93 and 95. These spaces define a lower air chamber. An upper air chamber UAC is defined in the space bounded by the coupling member 41 and in the space within the upper portion of the actuator 17 bounded by the wall 19.

A gasket seal 97 is captured between the upper end of the wall 94 and the end wall of upper housing portion 12. The center of this gasket is open at 98 to permit free flow from the lower air chamber to the opening 61.

The coupling member 41 is securely held to the container 11 by the latches 62 engaged over the outer edge of the annular wall 46 of the coupling member, and the actuator 17 is held assembled to the coupling member by frictional engagement between the tail piece 81 of the stem valve and the bore 22*a* of the hub 22, and by the frictional engagement between the wall 42 of the coupling member and the wall 19 of the actuator. The actuator can be removed when desired, however, for cleaning.

Figure 7:
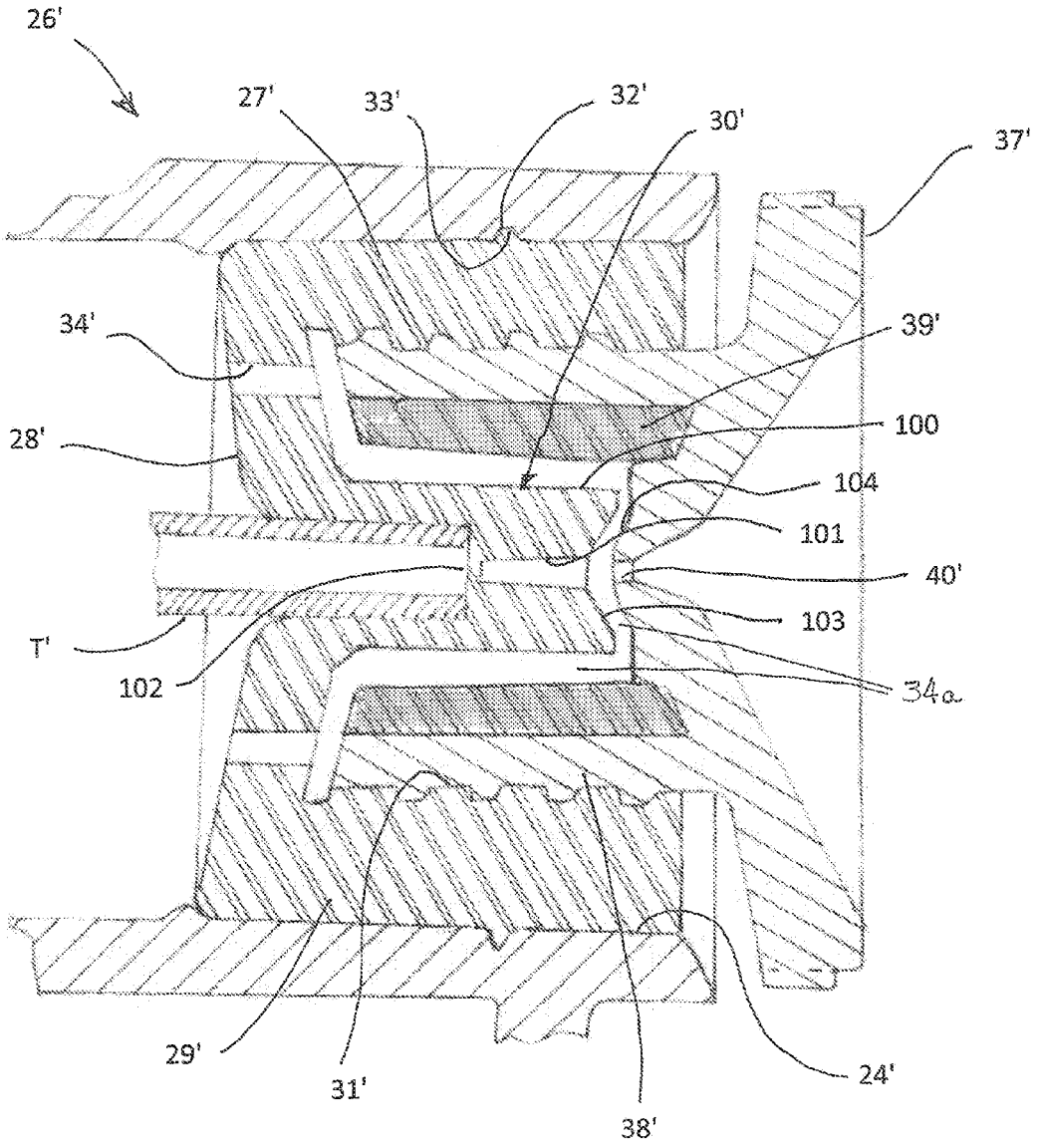
FIG. 7 is a greatly enlarged fragmentary sectional view of a modified air assist nozzle construction using a controlled product bleed feed fitment similar to and operated in sequence dispensing and function as in the FIGS. 2, 2*a*, and 2*b* embodiment.

A modified nozzle assembly 26' is shown in FIG. 7. This embodiment is constructed and functions essentially the same as the nozzle assembly 26 previously described except that the socket 30' has an extended end 100 with a slightly outwardly flared conical pocket 101 extending through its outlet end 103 and closed at its inner end by a membrane 102. Like parts are indicated by like reference characters primed. The outlet end 103 of the socket is concavely shaped and the front of the nozzle 37' adjacent the outlet end of the socket forms a complementary hemispheric pad 104. The membrane 102 is pierced to provide a controlled feed through the conical pocket and onto the mechanical breakup to form a spray that can be air assisted or unassisted. The membrane can have a molded hole instead of being pierced and the resultant feed would be uncontrolled but the mix would occur in the same manner. Product viscosity or density could determine some need to choose one or the other.

Figure 8:
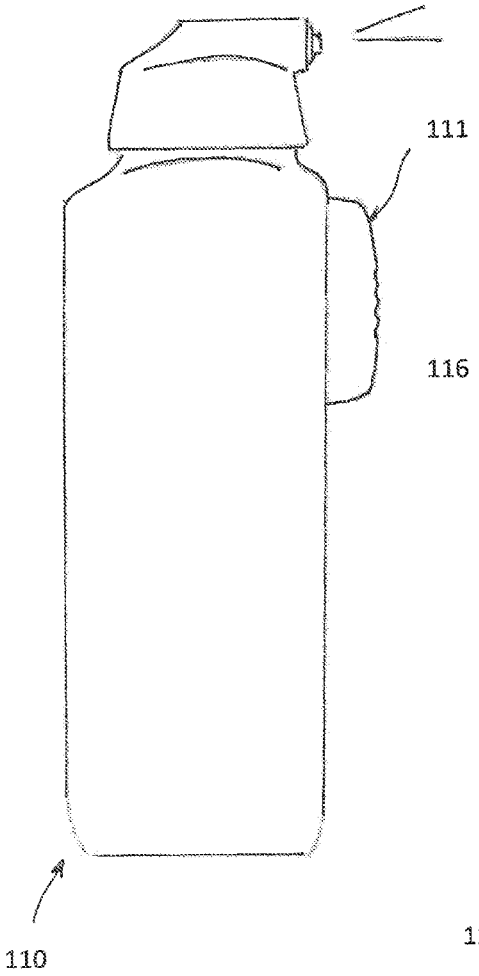
FIG. 8 is a side view in elevation of a dispenser having a side action pump means that can be used with the actuator and nozzle assemblies of FIGS. 2, 2*a*, 2*b*, 3 and 4.
Figure 9:
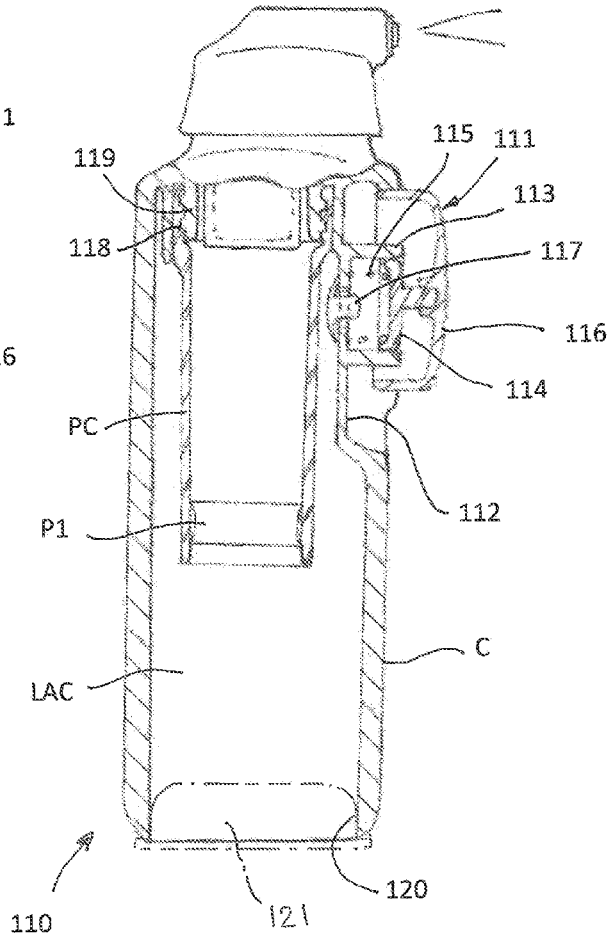
FIG. 9 is a longitudinal sectional view of the device of FIG. 8, showing the base seal plug in broken lines.

The device of the invention may be pressurized with any one of a variety of pressure sources, and one such source is shown at 110 in FIGS. 8 and 9. In this embodiment a side action pump 111 in the side of container C is used to pump air into the lower air chamber LAC to pressurize it and thus to move the piston P1 upwardly in product chamber PC to pressurize the product and force it out through one of the nozzle assemblies described above when the actuator is depressed as described hereinafter. The pump 111 comprises a recessed wall 112 in the side of container C near its upper end, and a pump cylinder 113 extending from the wall and opening outwardly through the side of the container. A piston 114 is reciprocal in the pump cylinder and is biased outwardly of the cylinder by a spring 115. An actuator 116 is connected with the pump to push it into the pump cylinder and pressurize air in the cylinder when the actuator is depressed. An opening through the wall 112 at the inner end of the pump cylinder is normally closed by an umbrella valve 117 that opens to admit pressurized air into the lower air chamber LAC when air in the pump cylinder is pressurized by depression of the actuator. The product chamber PC preferably is releasably attached to the container C so that it can be removed and refilled if desired. In the example shown, the product chamber has a threaded connection 118 to a receiver 119 in the upper end of the container. The bottom end 120 of container C in FIG. 9 would be closed by a plug or cap, shown in broken lines at 121.

Figure 10:
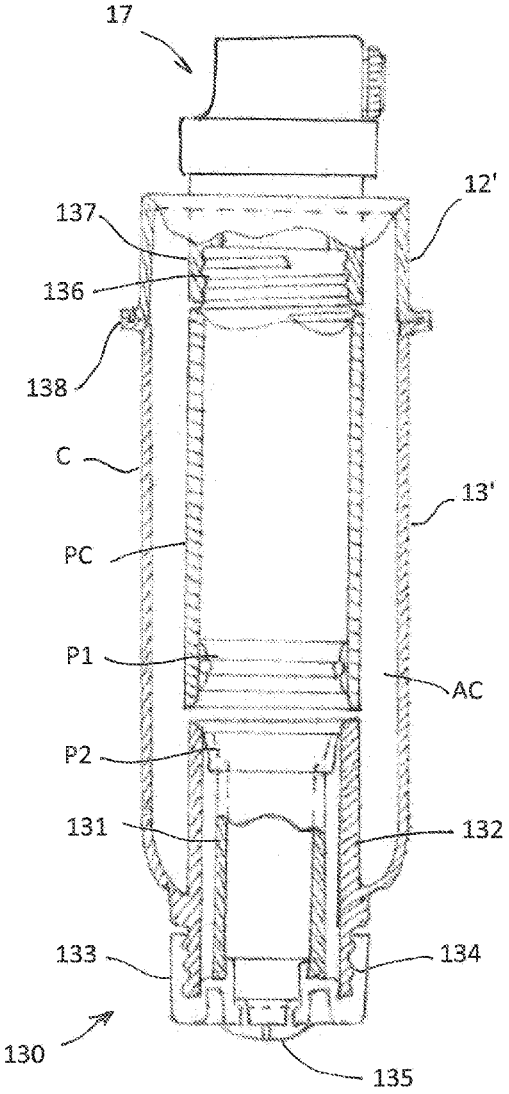
FIG. 10 is a longitudinal sectional view of a dispenser according to the invention using a base operated plunger to charge the system for usage with dispensing mechanisms as described in FIGS. 1, 2, 2*a*, 2*b*, and FIG. 4.

The bottom pump 130 shown in FIG. 10 is another way of pressurizing the container C. In this form of the invention, a piston P2 is mounted to one end of a hollow tube 131 for reciprocation in a pump cylinder 132 formed integrally with the bottom end of the container and extending upwardly into the container. The tube 131 is attached at its other end to a cap 133 removably attached to the end of the container by threads 134. An umbrella valve 135 is in the cap for admitting air into the tube 131 when the cap is unthreaded from the end of the container and pulled downwardly. Return of the piston P2 back up in the pump cylinder 132 pressurizes the air in air chamber AC and exerts pressure on piston P1 so that air and product are mixed and dispensed when the actuator 17 is operated as described hereinafter. The product chamber PC is threaded at 136 to a receiver 137 in the upper end of the container so that the product chamber can be removed and refilled if desired. The attachment 138 of lower container housing portion 13' to upper portion 12' can be releasable to permit the two portions to be separated to facilitate removal of the product chamber PC.

Figure 11:
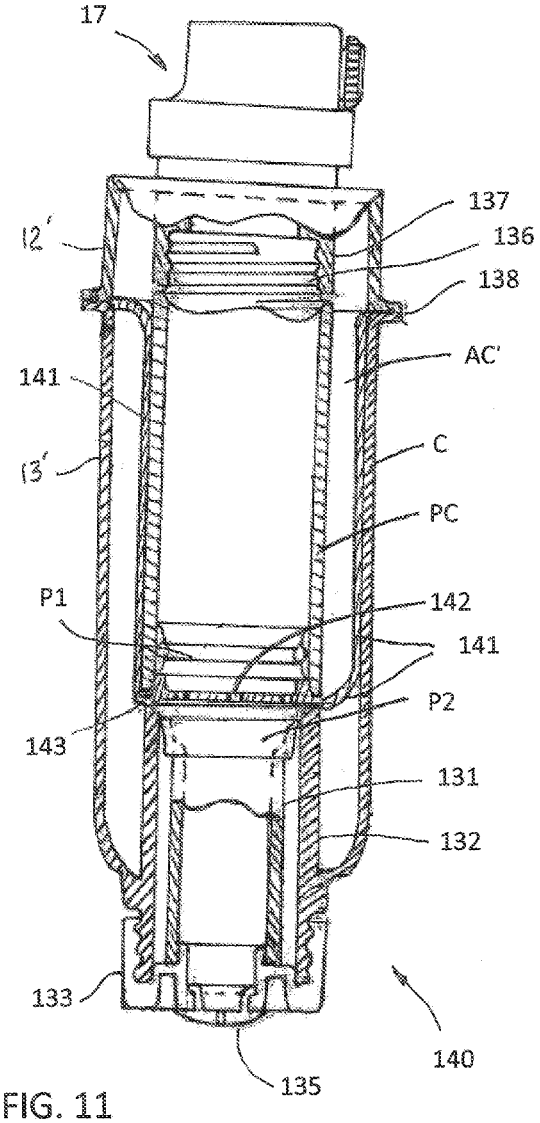
FIG. 11 is a longitudinal sectional view of a dispenser device similar to that shown in FIG. 10, but with an inflatable bladder or pouch, wherein the left side shows the bladder before inflation and the right side shows it after being inflated or distended to the inner wall of the outer container.

An alternate embodiment of bottom pump device is shown at 140 in FIG. 11. This form of the invention is essentially the same as that shown in FIG. 10, and parts in this FIG. 11 corresponding to like parts in FIG. 10 are indicated by like reference characters. This embodiment differs from that in FIG. 10 in that an inflatable pressure boosting bladder 141 is clamped at 138 at its open upper end between upper housing portion 12' and lower housing portion 13', with its bottom end against the bottom end of the product chamber PC so that the product chamber extends into the bladder. Although the upper end of the bladder is shown as clamped between the housing parts, it could be mounted in other ways. For example, juncture 138 can be sonic welded, solvent welded or threaded. As in the embodiment shown in FIG. 10, a piston P2 is mounted to one end of a hollow tube 131 for reciprocation in a pump cylinder 132 formed integrally with the bottom end of the container C and extending upwardly into the container. The tube 131 is attached at its other end to a cap 133 removably attached to the end of the container by threads 134. The bladder is shown deflated in the left hand side of the figure, and inflated in the right hand side. An umbrella valve 135 is in the cap for admitting air into the tube 131 when the cap is unthreaded from the end of the container and pulled downwardly. Pushing the piston P2 back up in the pump cylinder 132 pressurizes the air in the pump cylinder and one or more openings 142 formed through the lower end of the bladder admit pressurized air from the pump cylinder 132 to beneath the piston P1. One or more further openings 143 admit pressurized air to the air chamber AC' formed between the bladder and the product chamber.

Figure 12:
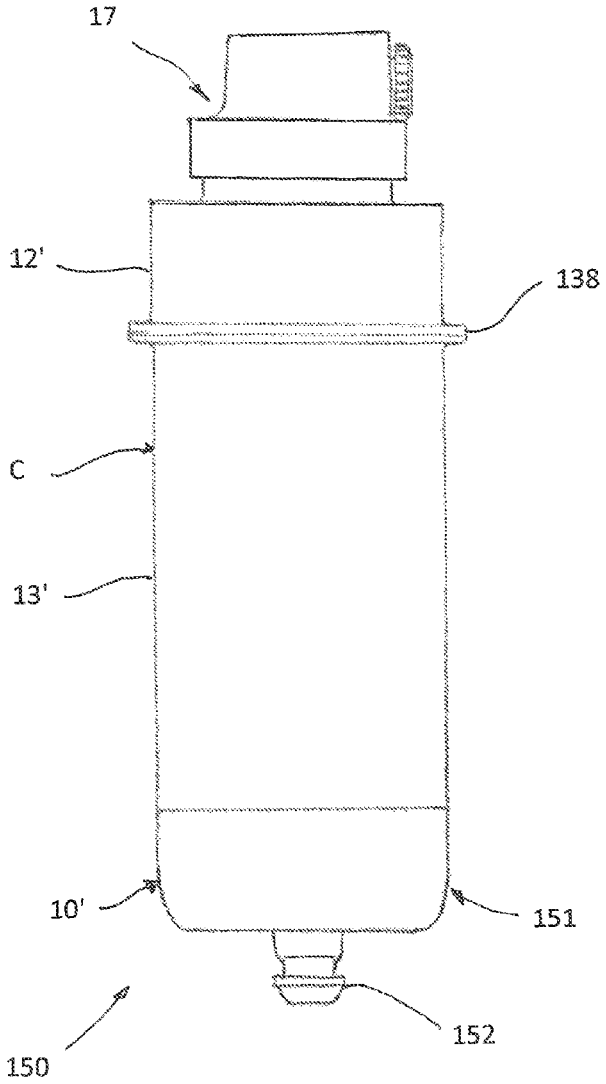
FIG. 12 is a side view in elevation of a further embodiment of dispensing device according to the invention, wherein the product is in a refillable cartridge (not shown) and a quick-disconnect adapter is positioned in the bottom of the container for attachment of an air hose to supply pressurized air from a suitable source.
Figure 13:
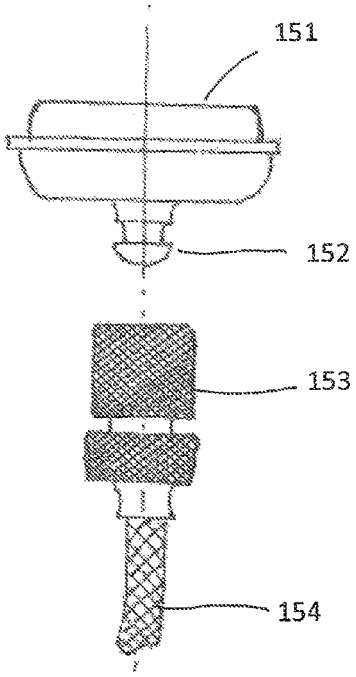
FIG. 13 is an exploded view in side elevation of a slightly modified quick-disconnect adapter and an associated air hose that can be used in the assembly of FIG. 12 and could be attached to the system in FIG. 1 as an alternate means of supply from a portable canister or regulated external air compressor unit.

A further embodiment for supplying pressurized air to the device is shown at 150 in FIGS. 12 and 13. In this form of the invention a quick connect adapter 151 is positioned in the bottom end of the container C for supplying pressurized air to the container from a cartridge of pressurized air, a compressor, or other source. In the particular example shown, the adapter has a male quick-connect fitting 152 for connection of a female connector 153 on an air hose 154 that leads to a compressor (not shown). This source of pressurization could be substituted for any of the bottom pump designs described above.

The actuator and nozzle assemblies described above are employed to dispense the product and air mix in the various embodiments disclosed, but there are common actuator assemblies that can accommodate and employ different mechanical breakup units (MBUs), as described in U.S. Pat. Nos. 6,609,666 and 6,543,703, for example.

In use, when the system is at rest and the actuator is not depressed, the parts have the relative positions shown in FIG. 2, with the lower end of first inner wall 20 in the actuator resting on the frustoconical wall 43 of the coupling member 41. The bottom end seal 22*c* of the hub is seated and sealed in the opening 45 at the bottom end 44 of the coupling member, and the lower end 44 is spaced from the shoulder 83 of the stem valve. The sliding seal 82 on the tail piece 81 is spaced a short distance below the intersection of tube T with bore 22*a*, and the downwardly facing flange 84 on the stem valve 80 rests on unflexed spring arms 55. The sliding seal 86 on the lower extension of the stem valve is positioned in the top of the seal pocket 70, and the valve seal 85 on the bottom end of the stem valve rests in closed position on the valve seat 71 in the bottom end of the seal pocket 70. If the lower air chamber defined by spaces 93 and 95 is not pressurized, the flap valve 54 remains in its closed position over opening 61, the upper air chamber UAC also remains unpressurized, and no air or product flows from the device. If the lower air chambers 93 and 95 are pressurized, the flap valve 54 will open to admit pressurized air into the space within the coupling member below the wall 43. Engagement of seal end 22*c* against end 44 of the wall 43 prevents pressurized air from flowing into the upper air chamber UAC.

When the actuator 17 is initially depressed as shown in FIG. 2*a*, the bottom edge of the first inner wall 20 in the actuator presses down on the flexible wall 43 of the coupling member, causing the bottom end 44 of the flexible wall 43 to move away from the end seal 22*c* on the bottom end of the hub 22, thereby establishing communication for flow of air between the lower air chamber defined by spaces 93 and 95 and the upper air chamber UAC. At this time, the bottom end 44 will be just resting on the shoulder 83 of the stem valve but the stem valve 80 will not have moved. At this time the valve seal 85 on the bottom end of the stem valve rests in closed position on the valve seat 71 in the bottom end of the seal pocket 70 and no product flows from the system. If the lower air chamber is pressurized, the flap valve 54 will open and pressurized air will flow from the lower air chamber into the upper air chamber and through the openings 34 in the fitment 27 and ultimately through the opening 40 in the nozzle 37.

Further depression of the actuator, as shown in FIG. 2*b*, results in the wall 20 and hub 22 pushing down on the stem valve to move it down, bending the spring arms 55 and unseating the valve seal 85 from the valve seat 71, enabling product to flow up around the bottom end of the stem valve from the product chamber PC and through the openings 87 into the hollow interior of the stem valve, into the tube T and through the openings 35 and 40. At the same time, air flows from the upper air chamber UAC through the openings 34 to mix with product P, and thence through opening 40.

Releasing the actuator essentially reverses the process described above in that the flexible wall 43 is enabled to move the actuator up, thereby enabling the spring arms 55 to move the stem valve up, closing the valve 85 against seat 71 and cutting off further flow of product, after which the bottom end 44 of wall 43 again seats against end 22*c* of the hub, cutting off further flow of air from the upper air chamber UAC.

All of the disclosed systems allow for isolating the product from the propellant gas (air or nitrogen) and manage whether or not the gas is mixed with the product. Some examples of when the air and product would not be mixed are the dispensing of toothpaste, gels, food products, conditioners and the like. Examples of products employing mixed air are hairsprays, some gels, room fresheners, mouthwash, medications, sun tanning sprays and many other types of products. The choice is primarily dictated by viscosity or density of the product to be dispensed.

The air assist feature may be a selected positional means that can function as part of a combination of air with product, or not take part in the breakup of the spray and be Isolated from affecting the spray. Additional control is possible by the selection of available nozzles and the need of how products feed with optimum results through them.

The simplicity of the present invention is evident. There is no stored chemical propellant that can be harmful to the environment. With the invention, the user simply pumps up and charges the system. As described, the release of product is sequentially obtained. In brief, the actuator is depressed and the first Intermediate position starts air flow. Continued depression of the actuator causes product to flow and mix with a preset and or prescribed selected adjustment of the nozzle if a mix is desired. By releasing the actuator, the sequence is reversed and air is discharged last from the nozzle. The system can thus be considered as a self-purging system. To eliminate the air mix and obtain product only, set the adjustable actuator accordingly. The adjustable actuator allows the consumer to select an appropriate setting for optimum results. If the manufacturer prefers to have optimum results by providing a fixed setting, it can be provided internally, before the customer purchases the product.

Accordingly, resort may be made to all suitable modifications and equivalents that fall within the scope of the present invention as defined by the claims which follow. The words "comprise", "comprising", "Include(s)" and "including" when used in this specification and in the following claims are intended to specify the presence of stated features or steps, but they do not preclude the presence or addition of one or more other features or means, steps or groups thereof.

What is claimed:

1. An actuator and nozzle assembly for a dispensing device for dispensing a product under pressure, comprising:

an outer container having a sidewall, a top end, and a bottom end, said top end having at least one flow port therethrough and a central opening;

attaching means on said top end for attaching a product chamber to said top end so that said product chamber is supported in said outer container in communication with said central opening;

a valve seal pocket formed in said central opening, said valve seal pocket having a valve seat therein;

a coupling member attached to said container top end on a side thereof opposite said attaching means, said coupling member having an upstanding side wall and a yieldable spring-like upper end wall with a downwardly projecting center portion having a center opening therethrough;

a combined valving and spring member secured between said container top end and said coupling member so that it is disposed around said central opening in said container top end, at least one spring arm extending inwardly from said valving and spring member in overlying spaced relation to said container top end, and a valve flap on said valving and spring member normally disposed in closed relationship over said at least one flow port through said container top end;

an actuator reciprocable on said coupling member, said actuator having a top wall, an outer side wall depending from said top wall and telescopically engaged on said coupling member side wall, said outer side wall having an opening through one side thereof adjacent said top wall, a first inner wall depending from said top wall in inwardly spaced concentric relation to said outer side wall, said first inner wall being engaged against said coupling member flexible upper end wall, and a center hub supported in inwardly spaced concentric relationship with said first inner wall, said hub having an upper end and a lower end and a bore extending through the lower end thereof, a side opening extending through one side of the hub adjacent said upper end thereof and communicating with an upper end of said bore, said side opening in said hub being in alignment with said opening through one side of the actuator outer side wall, and a bottom end seal on the bottom end of said hub, said bottom end seal normally seated against the coupling member upper end wall and closing the center opening therethrough;

a stem valve having an upper end and a lower end and having a hollow interior extending through said upper end from adjacent but spaced from said lower end, said upper end extending through the center opening in said spring-like upper end wall of said coupling member and being slidably sealed in the bore in said hub, the lower end of said stem valve extending into said valve seal pocket and having a sliding seal member thereon slidably sealed in said valve seal pocket and a valve member on said lower end for cooperation with the valve seat in the valve seal pocket, and at least one opening through a side of said stem valve between said sliding seal member and said valve member establishing fluid communication between said product chamber and said hollow interior when said valve member is unseated, said at least one spring arm engaged against a midportion of said stem valve to urge it into closed position, and said midportion defining an abutment against which the downwardly projecting center portion of said spring-like upper end wall of said coupling member abuts when said actuator is depressed;

said container and said product chamber defining a space between them forming a first portion of a lower air chamber, said upper end of said container and said coupling member forming a second portion of a lower air chamber, and said actuator and said flexible upper end wall of said coupling member forming an upper air chamber separated and sealed from said lower air chamber by seating of the bottom end seal on said hub against the coupling member upper end wall and closing the center opening therethrough;

pressure means for pressurizing said first portion of said lower air chamber and applying pressure to product in said product chamber, said valve flap being opened upon pressurization of said first portion of said lower air chamber to establish communication between said first and second portions of said lower air chamber and thus pressurize said second portion;

a nozzle secured in said opening through said opening in one side of said outer side wall of said actuator; and a tube extending from said opening in the side of said hub to said nozzle; wherein depression of said actuator to a first position moves said first inner wall against said flexible upper wall of said coupling member to flex said upper wall downwardly to unseat the bottom end seal on said hub from said center opening and admit pressurized air from said lower air chamber to said upper air chamber and through said nozzle, and continued depression of said actuator to a second position further moves said flexible upper end wall to abut said stem valve midportion and move said stem valve to unseat said valve member from the valve seat in the valve seal pocket and permit pressurized product to flow up through the hollow stem valve and through the tube to be dispensed through the nozzle, and wherein release of said actuator first enables said at least one spring arm to move said stem valve to a closed position to stop flow of product through the stem valve and nozzle while continuing to permit flow of pressurized air through the nozzle, and the flexible upper end wall of said coupling member then moves into closed relationship against said bottom end seal to close off flow of pressurized air.

2. An actuator and nozzle assembly for a dispensing device for dispensing a product under pressure, comprising:

an outer container having an upper end, said upper end having a flow port therethrough and a central opening;

a product chamber supported within said outer container;

a lower air chamber defined between said product chamber and said outer container;

pressurizing means for pressurizing air in said lower air chamber, said pressurized air exerting pressure on and pressurizing product in said product chamber;

an actuator mounted for reciprocation on said outer container;

nozzle means in said actuator;

first flow passage means extending from said lower air chamber to said nozzle means for conveying pressurized air from said lower air chamber to said nozzle means, said first flow passage means including said flow port;

second flow passage means extending from said product chamber to said nozzle means for conveying pressurized product from the product chamber to said nozzle means, said second flow passage means including said central opening;

first valve means in said first flow passage means for controlling flow of pressurized air from said lower air chamber to said nozzle means; and second valve means in said second flow passage means for controlling flow of product from said product chamber to said nozzle means, wherein said first and second valve means are operated by said actuator so that in a first reciprocated position of said actuator said first valve means is opened to enable flow of pressurized air from said lower air chamber to and through said nozzle means and in a further reciprocated position of said actuator said second valve means is opened to enable flow of product from said product chamber to and through said nozzle means, and wherein release of said actuator first interrupts flow of product then interrupts flow of pressurized air.

3. An actuator and nozzle assembly as claimed in claim 2, wherein:

said outer container has a side wall and a lower end;

a coupling member is attached to said outer container upper end;

said actuator is reciprocally mounted to said coupling member; and biasing means moves said first and second valve means to closed positions and returns said actuator to its at-rest position.

4. An actuator and nozzle assembly as claimed in claim 3, wherein:

said nozzle means has openings that establish communication between said first and second flow passage means whereby said pressurized air and product flowing through said nozzle means are mixed when said first and second valve means are both open.

5. An actuator and nozzle assembly as claimed in claim 4, wherein:

attaching means are on said outer container upper end for releasably attaching said product chamber to said outer container.

6. An actuator and nozzle assembly as claimed in claim 5, wherein:

said coupling member has an upstanding side wall and a yieldable spring-like flexible upper end wall with a downwardly projecting center portion having a center opening therethrough; and said actuator has a top wall and an outer side wall depending from said top wall and telescopically engaged on said coupling member side wall.

7. An actuator and nozzle assembly as claimed in claim 6, wherein:

said outer side wall of said actuator has an opening through one side thereof adjacent said top wall, and a first inner wall depends from said top wall in inwardly spaced concentric relation to said outer side wall, said first inner wall being engaged against said coupling member flexible upper end wall; and a center hub is supported in inwardly spaced concentric relationship with said first inner wall, said hub having an upper end and a lower end and a bore extending through the lower end thereof, a side opening extending through one side of the hub adjacent said upper end thereof and communicating with an upper end of said bore, said side opening in said hub being in alignment with said opening through one side of the actuator outer side wall, and a bottom end seal on the bottom end of said hub, said bottom end seal normally seated against the coupling member upper end wall and closing the center opening therethrough.

8. An actuator and nozzle assembly as claimed in claim 7, wherein:

said first valve means comprises a bottom end seal on a bottom end of said hub normally seated against the coupling member upper end wall and closing the center opening therethrough;

a valve seal pocket is formed in a central opening through said outer container upper end, said valve seal pocket having a valve seat therein; and said second valve means comprises a valve member on a lower end of a stem valve having an upper end and a lower end and a hollow interior extending through said upper end from adjacent but spaced from said lower end, said valve member on said lower end being movable into and out of closed relationship with the valve seat in the valve seal pocket, at least one opening through a side of said stem valve between said sliding seal member and said valve member establishing fluid communication between said product chamber and said hollow interior when said valve member is unseated, said at least one spring arm engaged against a midportion of said stem valve to urge it into closed position, and said midportion defining an abutment against which the downwardly projecting center portion of said spring-like upper end wall of said coupling member abuts when said actuator is depressed, said upper end of said stem valve extending through the center opening in said spring-like upper end wall of said coupling member and being slidably sealed in the bore in said hub, the lower end of said stem valve extending into said valve seal pocket and having a sliding seal member thereon slidably sealed in said valve seal pocket.

9. An actuator and nozzle assembly as claimed in claim 8, wherein:

a combined valving and spring member is secured between said outer container upper end and said coupling member so that it is disposed around said central opening in said outer container upper end, at least one spring arm extending inwardly from said valving and spring member in overlying spaced relation to said container upper end, and a valve flap on said valving and spring member is normally disposed in closed relationship over said at least one flow port through said outer container upper end.

10. An actuator and nozzle assembly as claimed in claim 9, wherein:

said outer container and said product chamber define a space between them forming a first portion of said lower air chamber, said upper end of said outer container and said coupling member forming a second portion of said lower air chamber, and said actuator and said flexible upper end wall of said coupling member forming an upper air chamber separated and sealed from said lower air chamber by seating of the bottom end seal on said hub against the coupling member upper end wall and closing the center opening therethrough; and said pressurizing means is operable to pressurize said first portion of said lower air chamber and apply pressure to product in said product chamber, said valve flap being opened upon pressurization of said first portion of said lower air chamber to establish communication between said first and second portions of said lower air chamber and thus pressurize said second portion.

11. An actuator and nozzle assembly as claimed in claim 10, wherein:

a tube extends from said opening in the side of said hub to said nozzle; and depression of said actuator to a first position moves said first inner wall against said flexible upper wall of said coupling member to flex said upper wall downwardly to unseat the bottom end seal on said hub from said center opening and admit pressurized air from said lower air chamber to said upper air chamber and through said nozzle, and continued depression of said actuator to a second position further moves said flexible upper end wall to abut said stem valve and move said stem valve to unseat said valve member from the valve seat in the valve seal pocket and permit pressurized product to flow up through the hollow stem valve and through the tube to be dispensed through the nozzle, and wherein release of said actuator first enables said at least one spring arm to move said stem valve to a closed position to stop flow of product through the stem valve and nozzle while continuing to permit flow of pressurized air through the nozzle, and the flexible upper end wall of said coupling member then moves into closed relationship against said bottom end seal to close off flow of pressurized air.

12. An actuator and nozzle assembly as claimed in claim 11, wherein:

said pressurizing means comprises a manually operated pump in said outer container lower end.

13. An actuator and nozzle assembly as claimed in claim 11, wherein:

said pressurizing means comprises a manually operated pump in said side wall of said outer container.

14. An actuator and nozzle assembly as claimed in claim 11, wherein:

said pressurizing means comprises a quick connect adaptor in said outer container lower end for connection to an external pressure source.

15. An actuator and nozzle assembly for a dispensing device for dispensing product under pressure, comprising:

an outer container having an upper end, a lower end, and a sidewall, said upper end having an opening therethrough;

a product chamber containing a product to be dispensed and having an upper end attached to the upper end of the outer container so that the product chamber depends into the outer container;

a coupling member attached to said outer container upper end on a side thereof opposite said product chamber, said coupling member having a flexible end wall with an opening therethrough;

an actuator mounted for reciprocation on said coupling member, said actuator having a center hub positioned in alignment with the opening through the coupling member end wall, said hub having a lower end seal that with said opening through said coupling member end wall defines a first valve means;

a stem valve having an upper end reciprocable in said hub and a lower end reciprocable in said opening through said outer container upper end, said valve stem lower end and said opening through said outer container upper end defining a second valve means;

a lower air chamber in said outer container between said outer container and said product chamber;

means to pressurize air in said lower air chamber, which in turn pressurizes the product in said product chamber;

a nozzle in said actuator;

first flow passage means from said lower air chamber to said nozzle, flow of pressurized air from said lower air chamber to said nozzle being controlled by said first valve means; and second flow passage means from said product chamber to said nozzle, flow of product from said product chamber to said nozzle being controlled by said second valve means; wherein reciprocation of said actuator through a first predetermined distance opens said first valve means to enable flow of pressurized air to and through said nozzle, continued reciprocation of said actuator through a second predetermined distance opens said second valve means to enable flow of product to and through said nozzle, and return movement of said actuator to an at-rest position first closes said second valve means to interrupt flow of product to the nozzle and then closes said second valve means to interrupt flow of air to said nozzle.

16. An actuator and nozzle assembly for a dispensing device for dispensing a product under pressure, comprising:

a product chamber supported within an outer container;

a lower air chamber defined between said product chamber and said outer container;

pressurizing means for pressurizing air in said lower air chamber, said pressurized air exerting pressure on said product in said product chamber;

an actuator mounted for reciprocation on said outer container;

nozzle means in said actuator;

first flow passage means extending from said lower air chamber to said nozzle means for conveying pressurized air from said lower air chamber to said nozzle means;

second flow passage means extending from said product chamber to said nozzle means for conveying product from the product chamber to said nozzle means;

first valve means in said first flow passage means for controlling flow of pressurized air from said lower air chamber to said nozzle means; and second valve means in said second flow passage means for controlling flow of product from said product chamber to said nozzle means, wherein a first reciprocated position of said actuator opens said first valve means to enable flow of pressurized air from said lower air chamber to said nozzle means and in a further reciprocated position of said actuator said second valve means is opened to enable flow of product from said product chamber to said nozzle means, and wherein release of said actuator and return of the actuator to an at-rest position first interrupts flow of product and then interrupts flow of pressurized air.

17. An actuator and nozzle assembly for a dispensing device for dispensing a product under pressure, comprising:

an outer container having an upper end, a lower end, and a sidewall, said upper end having an opening therethrough;

a product chamber containing a product to be dispensed and having an upper end releasably attached to the upper end of the outer container and supported therefrom so that the product chamber depends into the outer container, said product chamber upper end having an opening therethrough communicating with the opening through the outer container upper end;

a lower air chamber defined between said product chamber and said outer container;

pressurizing means for pressurizing air in said lower air chamber, which in turn pressurizes product in said product chamber;

a piston reciprocable in said product chamber and responsive to pressurized air in said lower air chamber to pressurize said product in said product chamber;

an actuator mounted to said outer container for reciprocation relative to said outer container;

nozzle means in said actuator;

first flow passage means extending from said lower air chamber to said nozzle means for conveying pressurized air from said lower air chamber to said nozzle means;

second flow passage means extending from said product chamber to said nozzle means for conveying product from the product chamber to said nozzle means;

first valve means in said first flow passage means for controlling flow of pressurized air from said lower air chamber to and through said nozzle means;

second valve means in said second flow passage means for controlling flow of product from said product chamber to and through said nozzle means; and wherein said first and second valve means are operated upon reciprocation of said actuator so that in a first reciprocated position of said actuator said first valve means is opened so that flow of pressurized air is enabled from said lower air chamber to and through said nozzle means, and in a second reciprocated position said second valve means is opened so that flow of product from said product chamber to and through said nozzle means is also enabled, and wherein release of said actuator first returns said second valve means to its closed position to interrupt flow of product and then said first valve means is returned to its closed position to interrupt flow of pressurized air.

* * * * *